United States Patent [19]

Nilssen

[11] Patent Number: 4,672,159

[45] Date of Patent: Jun. 9, 1987

[54] ELECTRICALLY CONTROLLABLE MAGNETRON POWER SUPPLY

[76] Inventor: Ole K. Nilssen, Caesar Dr., Barrington Hills, Ill. 60010

[21] Appl. No.: 673,715

[22] Filed: Nov. 21, 1984

[51] Int. Cl.[4] ..... H05B 6/68

[52] U.S. Cl. ..... 219/10.55 B; 363/98; 315/243; 331/87

[58] Field of Search ..... 219/10.55 B, 10.55 R; 363/17, 98, 132; 315/243, 242, 244, 241, 267, 273, 283; 331/86, 87, 185, 186, 113 A; 328/258, 261, 262, 267

[56] References Cited

U.S. PATENT DOCUMENTS

| | | | |
|---|---|---|---|
| 3,324,377 | 6/1967 | Mills | 363/17 |
| 3,569,855 | 3/1971 | Noda | 219/10.55 B X |
| 3,840,810 | 10/1974 | Fritts | 219/10.55 B X |
| 3,961,152 | 6/1976 | Staats | 219/10.55 B |
| 3,973,165 | 8/1976 | Hester | 331/87 X |
| 4,060,752 | 11/1977 | Walker | 315/243 X |
| 4,257,088 | 3/1981 | Nilssen | 315/243 X |
| 4,277,728 | 7/1981 | Stevens | 315/247 X |
| 4,307,353 | 12/1981 | Nilssen | 363/133 X |

*Primary Examiner*—Philip H. Leung

[57] ABSTRACT

In a power-line-operated electronic inverter-type power supply for the magnetron in a microwave oven, the unfiltered pulsed DC output of a full-wave rectifier is applied to a bridge inverter, the output of which is a 30 kHz squarewave voltage pulse-amplitude-modulated at 120 Hz. By way of a step-up voltage transformer, this 30 kHz output voltage is applied to a high-Q series-resonant L-C circuit. The Q-multiplied voltage developing across the tank capacitor of this L-C circuit is then rectified and filtered for 30 kHz ripple-voltage. The output resulting from this high-frequency rectification is a 120 Hz pulse-amplitude-modulated current-limited DC voltage suitable for direct application to the magnetron. The bridge inverter has to be triggered into oscillation; which oscillation ceases each time the magnitude of the inverter DC supply voltage decreases below a given threshold level. Under normal operation, for each cycle of the 120 Hz pulse-amplitude-modulated DC voltage that constitutes this DC supply voltage, the inverter starts and stops oscillation. Simple control means then permits the starting point of this oscillation to be phase-controlled in fashion similar to the way in which a Triac or an SCR can be phase-controlled. When the inverter power supply is operating under full power, due to the innate characteristics of the magnetron-loaded L-C series-resonant circuit, the power factor of the power drawn from the 60 Hz power line is nearly 100%.

16 Claims, 2 Drawing Figures

ELECTRICALLY CONTROLLABLE MAGNETRON POWER SUPPLY

BACKGROUND OF THE INVENTION

1. Field of the Invention

The present invention relates to electronic inverter-type means for controllably powering the magnetron in a microwave oven with power derived from a regular electric utility power line.

2. Description of Prior Art

Electronic inverter-type power supplies for powering the magnetron in microwave ovens have been described in previous literature, such as in U.S. Pat. Nos. 3,973,165 to Hester and 4,002,875 to Kiuchi et al.

However, prior art power supplies of this type suffers from lack of cost-effectivity as well as from various functional limitations, such as lack of simple means for electrically controlling the power fed to the magnetron, poor regulation of the magnitude of the magnetron anode current, poor power factor of the power supplied to the magnetron, poor power factor of the power drawn from the power line, high-frequency modulations on the magnetron anode current, and/or excessive peak-to-average magnetron power.

SUMMARY OF THE INVENTION

Objects of the Invention

One object of the present invention is that of providing for a cost-effective inverter-type power supply operative to properly power the magnetron in a microwave oven with power derived from an ordinary electric utility power line.

Another object is that of providing for an inverter-type magnetron power supply wherein the power supplied to the magnetron can be effectively controlled by simple electrical control signals provided to the inverter.

This as well as other important objects and advantages of the present invention will become apparent from the following description.

Brief Description

In its preferred embodiment, subject invention consists of the following main component parts: (a) Rectifier means connected with a regular 120Volt/6O Hz power line and operative to provide an output of unfiltered low-magnitude DC supply voltage;

(b) Full-bridge self-oscillating inverter connected with this low-magnitude DC supply voltage and operative to provide a high-frequency output of low-magnitude 30 kHz squarewave voltage, the instantaneous absolute magnitude of this squarewave voltage being substantially equal to that of the low-magnitude DC supply voltage (the instantaneous absolute magnitude of which is equal to that of the power line voltage);

(c) A step-up voltage transformer connected with this low-magnitude squarewave voltage and operative to provide a medium-magnitude squarewave voltage at an intermediary output;

(d) A resonant combination of an inductor and a capacitor connected in series across this intermediary output and operative by way of Q-multiplication to generate a current-limited high-magnitude 30 kHz AC voltage between a pair of AC output terminals connected across the capacitor, the amount of 30 kHz power available from these AC output terminals at any given moment being substantially proportional to the instantaneous absolute magnitude of the low-magnitude DC supply voltage supplied to the inverter means;

(e) High-frequency rectifier and filter means connected with these AC output terminals and operative to provide a current-limited high-magnitude DC output voltage, this high-magnitude DC output voltage being substantially free of high-frequency ripple and operative to supply a flow of power that is substantially proportional in magnitude to the absolute instantaneous magnitude of the low-magnitude DC supply voltage; and (f) Means to apply this current-limited high-magnitude DC output voltage to the magnetron in a microwave oven.

Hence, the instantaneous absolute magnitude of the direct current provided to the anode of the magnetron is proportional to that of the unfiltered low-magnitude DC voltage supplied to the inverter; which, in turn, implies that the instantaneous magnitude of the current drawn from the power line is proportional to that of the power line voltage.

The self-oscillating inverter is so arranged that it has to be triggered into oscillation. However, once triggered, it will continue to oscillate until the instantaneous magnitude of its DC supply voltage falls below a certain minimum threshold level. Thus, since the inverter's DC supply voltage is unfiltered full-wave-rectified 60 Hz power line voltage, to provide magnetron power on a continuous basis, the inverter must be re-triggered into oscillation once for each half-cycle of the 60 Hz power line voltage.

Means have been provided whereby the point at which the inverter is triggered into oscillation can be electrically controlled; which implies that the power to the magnetron can be adjusted and/or switched on/off by simply providing electrical control signals to control the inverter trigger point—in a manner similar to the way in which a Triac in an AC circuit can be phase-controlled.

Since power is extracted from the inverter by way of a series-resonant circuit, the power factor associated with the inverter's 30 kHz output power is nearly 100%.

DESCRIPTION OF THE PREFERRED EMBODIMENT

Details of Construction

Figure 1:
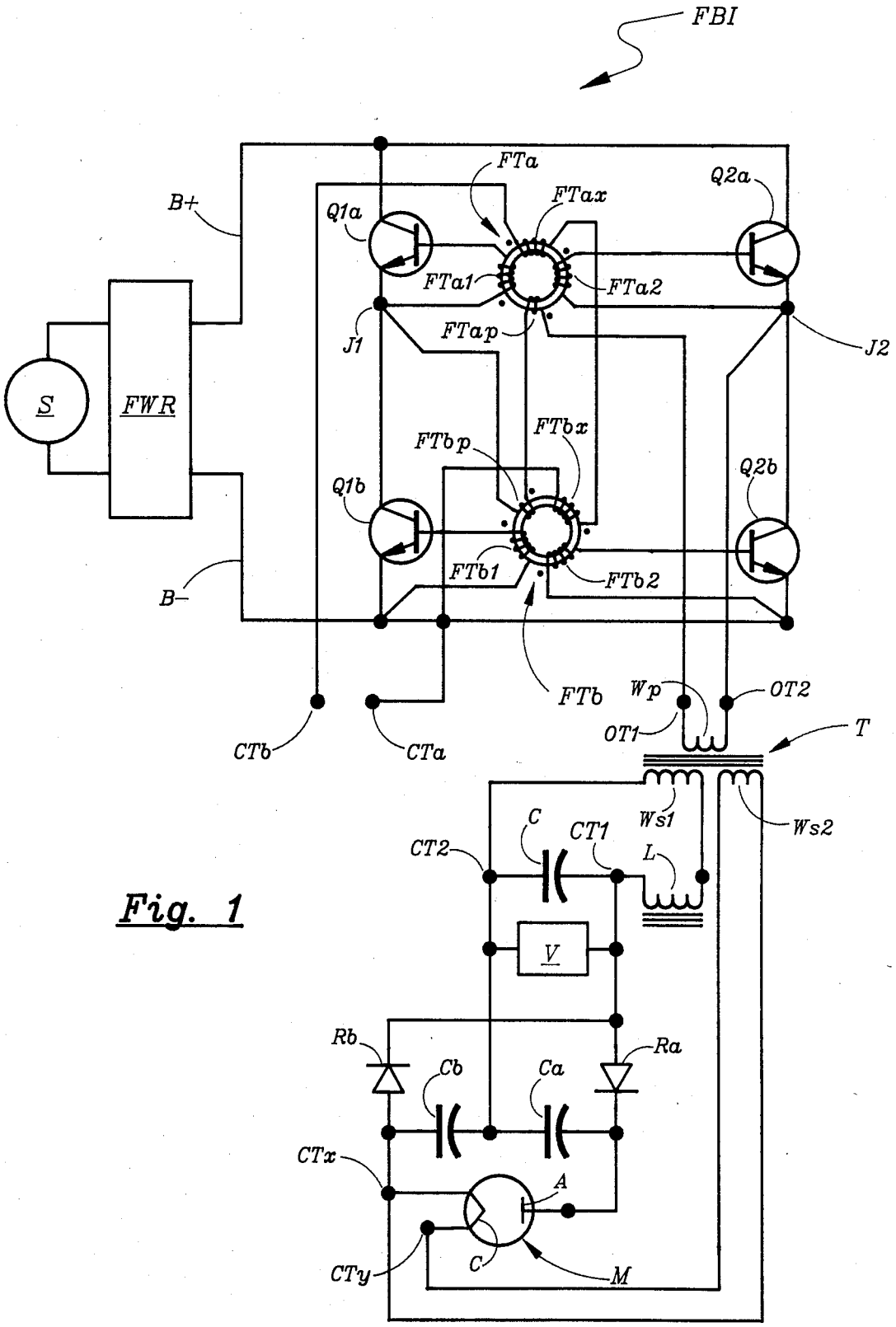
FIG. 1 schematically illustrates the preferred embodiment of the invention.

FIG. 1 shows an AC voltage source S, which in reality is an ordinary 120 Volt/60 Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Ql1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FTap of saturable feedback transformer FTa and primary winding FTbp of saturable feedback transformer FTb are connected in series between junction J1 and inverter output terminal OT1. Inverter output terminal OT2 is connected directly with junction J2.

A first secondary winding FTa1 of feedback transformer FTa is connected between the base and the emitter of transistor Q1*a*; a second secondary winding FTa2 of feedback transformer FTa is connected between the base and the emitter of transistor Q2*a*.

A first secondary winding FTb1 of feedback transformer FTb is connected between the base and the emitter of transistor Q1*b*; a second secondary winding FTb2 of feedback transformer FTb is connected between the base and the emitter of transistor Q2*b*.

Auxiliary windings FTax and FTbx of feedback transformers FTa and FTb, respectively, are connected in series between control terminals CTa and CTb.

The complete assembly consisting of transistors Q1*a*, *Q1b*, Q2*a* and Q2*b*, and feedback transformers FTa and FTb, constitutes full-bridge inverter FBI.

Primary winding Wp of power transformer T is connected with inverter output terminals OT1 and OT2.

A capacitor C and an inductor L are connected in series aross a first secondary winding Ws1 of transformer T. The two cathode terminals CTx and CTy of cathode C of magnetron M are connected with a second secondary winding Ws2 of power transformer T.

A voltage-limiting Varistor V is connected across capacitor terminals CT1 and CT2 of capacitor C.

A first rectifier Ra is connected between capacitor terminal CT1 and anode A of magnetron M, this first rectifier's anode being connected with CT1; a second rectifier Rb is connected between capacitor terminal CT1 and terminal CTx of cathode C, this second rectifier's cathode being connected with CT1.

Two capacitors Ca and Cb are connected in series between anode A and cathode terminal CTx—with one terminal of capacitor Ca being connected with anodes A, and one terminal of capacitor Cb being connected with cathode terminal CTx. The other terminal of each capacitor are both connected with terminal CT2 of capacitor C.

Details of Waveforms

Figure 2:
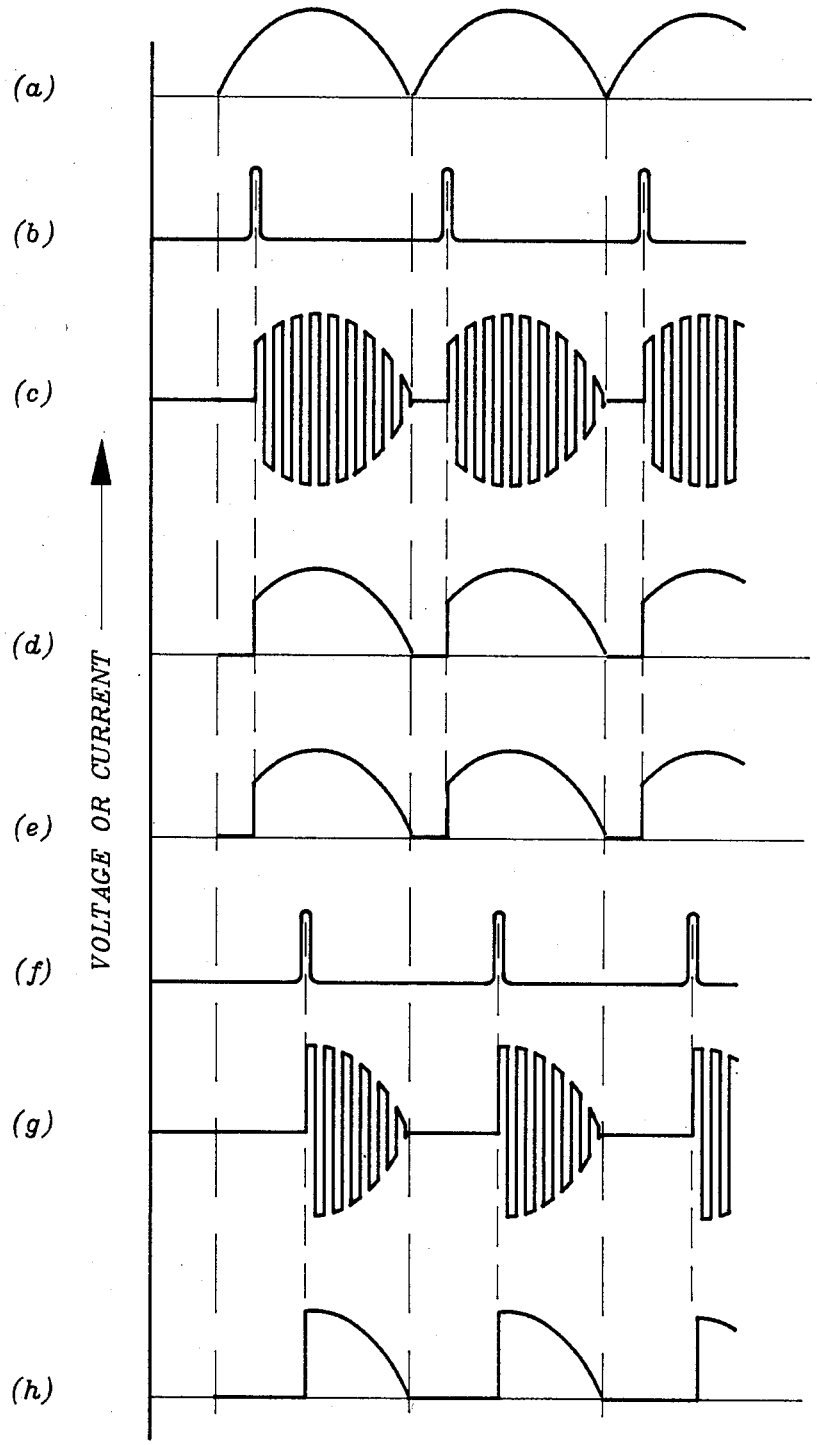
FIG. 2 shows various voltage and current waveforms associated with the preferred embodiment of the invention.

FIG. 2*a* shows the voltage between the B+ bus and the B− bus. Thus, the waveform of FIG. 2*a* is simply that of an unfiltered full-wave-rectified 120 Volt/60 Hz power line voltage.

FIG. 2*b* shows the inverter trigger pulses provided between control terminals CTa and CTb under the condition of having a near-maximum amount of power flowing to the magnetron; and FIG. 2*c* shows the corresponding high frequency squarewave voltage existing between inverter output terminals OT1 and OT2.

FIG. 2*d* shows the waveform of the current provided to the magnetron; and

FIG. 2*e* shows the corresponding current drawn from the power line (i.e.,from source S).

FIG. 2*f* shows the inverter trigger pulses provided between control terminals CTa and CTb under the condition of having substantially less than maximum power flowing to the magnetron.

FIG. 2*g* shows the high frequency squarewave voltage then existing between inverter output terminals OT1 and OT2; and FIG. 2*h* shows the corresponding magnetron current.

DESCRIPITON OF OPERATION

The operation of the arrangement of FIG. 1 may be further explained as follows.

The full-bridge inverter is arranged with positive current-feedback by way of saturable current transformers FTa and FTb in such a way as to self-oscillate, provided however that a DC voltage of adequate magnitude is present between the B+ bus and the B− bus and that a triggering current pulse has been provided through auxiliary windings FTax and FTbx.

Assuming the polarity of the triggering pulse to be positive (in terms of current flowing into control terminal CTa) and adequate in magnitude, the effect of the triggering pulse is that of momentarily rendering transistors Q2*a* and Q1*b* conductive; which then starts current flowing from the B+ bus, through Q2*a* and the primary winding of power transformer T, in direction from J2 to J1, and then though Q1*b* to the B− bus. Hence, current starts flowing through primary windings FTap and FTbp of the feedback transformers in such a direction as to perpetuate the conductive states of transistors Q2*a* and Q1*b*.

However, feedback transformers FTa and FTb are both saturable; and after a brief period, both of these feedback transformers saturate, at which point base current ceases to be provided to the two conducting transistors Q2*a* and Q1*b*, thereby rapidly rendering them non-conductive.

Due to inductively stored energy (as stored in leakage inductance of the primary winding Wp of transformer T and/or in inductor L) current will continue to flow from junction J2 to junction J1 for some brief period after transistors Q2*a* and Q1*b* have ceased to conduct. This current will flow until the inductively stored energy has been discharged.

However, the path of this discharging inductive current will not be through transistors Q2*a* and Q1*b*. Rather, it will be through transistors Q2*b* and Q1*a*: on the one side it will flow from the B− bus, through the FIb2 winding, through the base-collector junction of transistor Q2*b*, and to junction J2; while on the other side it will flow from junction J1, through winding FTa1, through the base-collector junction of transistor Q1*a*, and to the B+ bus.

Due to charge storage effects in the transistor junctions, and as a result of the reverse current-flow through transistors Q2*b* and Q1*a*, these two transistors have both been rendered temporarily conductive in their forward directions. Hence, both these transistors will be forwardly conductive for a brief period after the inductive discharge current has stopped flowing therethrough. During this brief period, forward current starts flowing from the B+ bus, through transistor Q1*a*, from junction J1 through primary winding Wp to J2, through transistor Q2*b*, and then to the B− bus, thereby initiating a new self-sustaining inverter cycle.

Thus, as long as the magnitude of the DC voltage present between the B+ bus and the B− bus is above a certain minimum level, the inverter will exhibit self-sustaining oscillations, thereby providing a squarewave voltage between its output terminals OT1 and OT2.

Except for relatively small voltage drops across the transistors, the absolute magnitude of this output squarewave voltage will be the same as that of the DC voltage between the B+ bus and the B− bus. Thus, as the magnitude of this DC voltage varies, so does the magnitude of the squarewave voltage.

However, if the magnitude of the DC voltage drops below a certain minimum level—which level might be on the order of 10 Volt—the inverter is no longer capable of self-sustained operation, and the oscillation ceases.

Thus, since the DC voltage present between the B+ bus and the B− bus—being unfiltered full-wave-rectified 60 Hz AC voltage—consists of a series of sinusoidally-shaped voltage pulses provided at a rate of 120 Hz (see FIG. 1*a*), the inverter must cease its oscillation toward the end of each of these voltage pulses. Hence, for inverter output to be provided on a continuous basis, the inverter must be re-triggered into oscillation for each and every one of the voltage pulses—as indicated by FIG. 2*b*—with the resulting inverter output then being as illustrated in FIG. 2*c*.

By varying the timing of the trigger pulses relative to the phasing of the voltage pulses, the time period during which the inverter oscillates can be varied in a manner identical with the way the conduction angle of a Triac or SCR can be varied. By not providing trigger pulses at all, the inverter simply does not oscillate and no inverter output results.

FIGS. 2*f*, 2*g* and 2*h* depict a situation of reduced power output from the inverter, where the trigger pulses are provided approximately in the middle of each of the DC voltage pulses.

The voltage provided across the series-connected inductor L and capacitor C from the secondary winding of power transformer T is substantially of the same shape as that provided across the inverter output terminals, but it is larger in magnitude. The L and the C are chosen such as to have relatively high Q-factors and to be substantially series-resonant at the frequency of the squarewave inverter output voltage (which is approximately of 30 kHz fundamental frequency). Thus, the current flowing through the L-C series-resonant circuit will be substantially sinusoidal of waveshape and in phase with the fundamental frequency component of the squarewave voltage. In turn, this means that—absent voltage limiting means—the AC voltage developed across capacitor C will be sinusoidal of waveshape and very large in magnitude.

Under normal conditions, the magnetron will represent a voltage-limiting load to the L-C circuit. However, during the brief period before the magnetron's cathode reaches a point of substantial thermionic emission, voltage limiting is provided by Varistor V.

The voltage present across C and therefore across terminals CT1 and CT2, is provided to a voltage-doubling rectifier/filter means consisting of Ra, Rb, Ca and Cb. The output of this voltage-doubling rectifier/filter means consists of a series of voltage pulses occurring at the rate of 120 Hz. Due to the particular voltage-current characteristics of the magnetron, the shape of these voltage pulses will be nearly trapezoidal—or: sinewaves with a substantially flat top.

On the other hand, as illustrated in FIG. 2*d*, the current provided to the magnetron will be in the form of unidirectional pulses of shape nearly identical to that of the DC voltage pulses existing between the B+ bus and the B− bus.

In this connection, it is noted that the amount of power provided to a constant-voltage load connected in parallel with the capacitor in a series-resonant L-C circuit is essentially proportional to the magnitude of the AC voltage provided at the input to the series-resonant circuit. Thus, for the very reason that the load is a constant-voltage load, the magnitude of the current through the load must be proportional to the magnitude of the AC voltage provided at the input to the series-resonant circuit.

In other words, a series-resonant circuit voltage-fed from an AC source and with its load connected in parallel with its tank capacitor, represents a perfect way to power a load such as a magnetron; which is effectively a constant voltage load that operates best when powered from a constant current source.

Thus, in the circuit of FIG. 1, as long as the inverter oscillates, the magnitude of the resulting magnetron current will be proportional to the magnitude of the DC voltage present between the B+ bus and the B− bus.

The capacitance values of the two filter capacitors Ca and Cb are so chosen as to provide for energy storage that is large compared with the amount of energy used by the magnetron during a single cycle of the 30 kHz inverter AC voltage, but small compared with the amount of energy used by the magnetron during a single one of the 120 Hz DC voltage pulses. As a result, the current pulses provided to the magnetron will have very little 30 kHz ripple.

It is noted that, if the magnetron current were provided from unfiltered rectified 30 Hz AC voltage, then—in order to provide for a given amount of average magnetron power—it would be necessary that the peak magnitudes of the resulting 30 kHz DC current pulses be very much larger than the peak current that results without when there is filtered rectification of the 30 kHz AC voltage.

It is also noted that the electrically controlled provision and phasing of the trigger pulses shown in FIGS. 2*b* and 2*f* can be accomplished in a number of well known ways, the details of which form no part of this invention.

It is important that the length of time that it takes for the saturable feedback transformers FTa and FTb to saturate be somewhat shorter than the period of the natural resonance frequency of the series-combination of inductor L and capacitor C. Ideally, the transformer saturation time should be such that when it is added to the transistor's storage time, the total equals the period of the natural resonance frequency.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A power supply arrangement comprising:

a magnetron;

a source of DC voltage, said DC voltage being amplitude-modulated at a relatively low frequency;

inverter connected with said source and operable to provide a squarewave voltage at an inverter output, said squarewave votlage being of a relatively high frequency while being amplitude-modulated at said relatively low frequency; and matching and rectifying means conected between the inverter output and the magnetron, and operable to provide to the magnetron a limited unidirectional current that is significantly amplitude-modulated at said relatively low frequency while being insignificantly amplitude modulated at said relatively high frequency.

2. The power supply arrangement of claim 1 wherein said inverter comprises control input means adapted to receive control signals operative to render the inverter controllably operable or non-operable.

3. The power supply of arrangement claim 1 wherein said inverter comprises control input means adapted to receive control signals operable to control the average magnitude of the current supplied to the magnetron.

4. The power supply of claim 1 wherein said matching and rectifying means comprises an L-C circuit that is resonant at or near said relatively high frequency.

5. An arrangement comprsing:

a magnetron;

rectifier means connected with the AC voltage on an ordinary electric utility power line and operative to provide an output of unfiltered DC voltage;

inverter connected with said DC voltage and operable to provide a squarewave voltage at an inverter output, the frequency of said squarewave voltage being substantially higher than that of said AC voltage;

matching and rectifying means connected with said inverter output and operative to provide unidirectional current to said magnetron; and means operative to make the instantaneous magnitude of said unidirectinal current substantially proportional to that of said DC voltage.

6. A microwave oven power supply adapted to be powered from the relatively low frequency AC voltage on an ordinary electric utility power line and operable to provide power to a magnetron, comprising:

rectifier means connected with said power line and operable to provide a non-filtered DC voltage;

inverter connected with said DC voltage and operative to provide a relatively high frequency squarewave voltage at an inverter output, said high frequency squarewave voltage being of frequency substantially higher than that of said low frequency AC voltage and having an instantaneous absolute magnitude that is substantially proportional to that of said DC voltage; and matching and rectification means connected between the inverter output and the magnetron, and operative to provide to the magnetron a unidirectional current of instantaneous absolute magnitude substantially proportional to that of said DC voltage and therefore essentially devoid of ripple at or above the frequency of said high frequency squarewave voltage.

7. The power supply of claim 6 wherein said DC voltage is a non-filtered full-wave-rectified power line voltage.

8. The power supply of claim 6 wherein said matching and rectifying means comprises an L-C circuit resonant at or near the frequency of said high frequency squarewave voltage.

9. A power supply for a magnetron, comprising:

conversion means connected with the AC voltage on an ordinary electric power line and operable to provide voltage at a squarewave output, the frequency of this voltage being substantially higher than that of said low frequency AC voltage; and matching and rectifying means connected with this squarewave output and operative to provide to the magnetron a unidirectional current of instantaneous absolute magnitude that is substantially proportional to that of said AC voltage and therefore essentially devoid of amplitude modulations at or above the frequency of said squarewave voltage.

10. The power supply arrangement of claim 9 wherein said conversion means comprises control input means adapted to receive control signals operable to controllably affect the flow of current to the magnetron.

11. The power supply of arrangement claim 9 wherein said matching and rectifying means comprises an L-C circuit that is series-resonant at or near the fundamental frequency of said squarewave voltage.

12. In a microwave oven power supply connected with the voltage on an ordinary electric power line and adapted to power a magnetron, and means operative to provide to the magnetron a unidirectional current of instantaneous absolute magnitude substantially proportional to that of said voltage.

13. The improvement of claim 12 wherein said means comprises:

frequency conversion means operative to convert said voltage to a squarewave voltage of frequency substantially higher than that of said line voltage;

high-Q series-connected L-C circuit connected with said squarewave voltage and resonant at or near the fundamental frequency thereof, said L-C circuit providing an AC voltage at an output; and rectifier means connected with this output and operative to provide said unidirectional current to the magnetron.

14. The improvement of claim 12 wherein said means comprises a series-resonant L-C circuit.

15. In a microwave oven power supply adapted to be powered from the AC voltage on an ordinary electric power line and operable to power a magnetron, the improvement comprising:

frequency conversion means operative to convert the AC voltage into a squarewave voltage, the frequency of said sqaurewave voltage being substantially higher than that of said AC voltage; and voltage conditioning means connected with said sqaurewave voltage and operative to provide unidirectional current pulses to the magnetron, said current pulses being provided at a repetition rate not higher than twice the frequency modulations at frequencies equal to or higher than that of said squarewave voltage.

16. The improvement of claim 15 wherein the magnitude of said current pulses can be controllably adjusted by way of electrical control signals provided to said frequency conversion means.

* * * * *